US010151232B2

(12) United States Patent
Lindeblad

(10) Patent No.: US 10,151,232 B2
(45) Date of Patent: Dec. 11, 2018

(54) STORAGE TANK

(71) Applicant: Ningbo Geely Automobile Research & Development Co., Ltd., Ningbo (CN)

(72) Inventor: Ola Lindeblad, Gothenburg (SE)

(73) Assignee: Ningbo Geely Automobile Research & Development Co., Ltd., Ningbo (CN)

( * ) Notice: Subject to any disclaimer, the term of this patent is extended or adjusted under 35 U.S.C. 154(b) by 0 days.

(21) Appl. No.: 15/822,856

(22) Filed: Nov. 27, 2017

(65) Prior Publication Data

US 2018/0073422 A1 Mar. 15, 2018

Related U.S. Application Data

(63) Continuation of application No. PCT/EP2016/061910, filed on May 26, 2016.

(30) Foreign Application Priority Data

Jul. 2, 2015 (SE) ..... 15509466

(51) Int. Cl.
*F01P 11/02* (2006.01)

(52) U.S. Cl.
CPC ..... *F01P 11/0204* (2013.01); *F01P 11/029* (2013.01)

(58) Field of Classification Search
CPC ..... B65D 25/04; B60K 2015/03118; B60K 2015/03368; F02M 37/0088; F02M 37/0094; F01P 11/29; F01P 11/0204
See application file for complete search history.

(56) References Cited

U.S. PATENT DOCUMENTS 3,393,717 A 7/1968 Holmes
3,973,602 A 8/1976 Kruse
(Continued)

FOREIGN PATENT DOCUMENTS

CN 101149013 A 3/2008
CN 201373767 Y 12/2009
(Continued)

OTHER PUBLICATIONS

The PCT Notification of the Recording of a Change dated May 26, 2016 for PCT application PCT/EP2016/061910, 1 page.
(Continued)

*Primary Examiner* — Timothy L Maust
*Assistant Examiner* — Timothy P Kelly
(74) *Attorney, Agent, or Firm* — Lee & Hayes, PLLC

(57) ABSTRACT

A storage tank for storing a liquid comprises a main storage chamber; an internal sub chamber located within the storage tank; and a reclosable filling opening for enabling filling of liquid into the main storage chamber and internal sub chamber. An overflow level of the internal sub chamber is located substantially at or above a predetermined fill level of the main storage chamber. The reclosable filling opening and the internal sub chamber are arranged in a substantially superposed relationship in a vertical direction, such that a substantially or entirely vertical stream of liquid filling the storage tank via the reclosable filling opening is configured to enter the internal sub chamber. A method for filling a storage tank with a liquid, a method for manufacturing a storage tank for storing a liquid, and a system comprising a storage tank and a filling nozzle are also described.

21 Claims, 3 Drawing Sheets

(56) References Cited

U.S. PATENT DOCUMENTS

| | | | | |
|---|---|---|---|---|
| 4,738,228 | A | 4/1988 | Jenz et al. | |
| 4,773,260 | A * | 9/1988 | Ohno | F02M 37/0094 340/450.2 |
| 8,074,819 | B2 * | 12/2011 | Dexter | F01P 11/029 137/571 |
| 9,718,599 | B2 * | 8/2017 | Casey | B65D 81/3216 |
| 2009/0159019 | A1 | 6/2009 | Hutchins | |
| 2011/0210125 | A1 * | 9/2011 | Kardos | F01P 11/029 220/502 |

FOREIGN PATENT DOCUMENTS

| | | | |
|---|---|---|---|
| CN | 104520553 | | 4/2015 |
| EP | 0215369 | A2 | 3/1987 |
| EP | 2711224 | A1 | 3/2014 |
| FR | 2918623 | A1 | 1/2009 |
| GB | 2455743 | A | 6/2009 |
| WO | WO2014013365 | A1 | 1/2014 |
| WO | WO2014051501 | A1 | 4/2014 |

OTHER PUBLICATIONS

The PCT Notification of Transmittal of the International Preliminary Report on Patentability dated Jun. 23, 2017 for PCT application PCT/EP2016/061910, 6 pages.

The PCT Publication and International Search Report dated Aug. 29, 2016 for PCT/EP201/6061910, 35 pages.

The Chinese Office Action dated Jun. 22, 2018 for Chinese Application No. 201680033442.3, a counterpart foreign application of U.S. Appl. No. 15/822,856, 9 pages (Need English Translation).

* cited by examiner

STORAGE TANK

RELATED APPLICATION

This application is a continuation of PCT International Application No. PCT/EP2016/061910, filed May 26, 2016, which claims foreign priority to Sweden Application No. 1550946-6, filed on Jul. 2, 2015, both of which are incorporated herein by reference.

TECHNICAL FIELD

Example embodiments presented herein are directed towards a storage tank for storing a liquid. Example embodiments are also directed towards a method for filling a storage tank with a liquid, a method for manufacturing a storage tank for storing a liquid, as well as a system comprising a storage tank and a filling nozzle.

BACKGROUND

Tanks or other containers are used in many situations to store resources, such as liquids, for use or re-use. Equipment or machines which use liquids may require different amounts of liquid at different points in time, which makes the storing of these liquids an important piece of said equipment or machine. These liquids could be used to perform various functions depending on the equipment or machine and the liquid itself, such as cooling, hydraulics, lubrication, measuring or being expelled or taken in.

One specific example employment for storage tanks is use as expansion tanks. An expansion tank is a storage tank which is adapted to compensate for thermal expansion of the liquid in a liquid system. If the temperature of the liquid in the liquid system increases, the liquid thus has room to expand without damaging the equipment of the liquid system, and sufficient liquid is available in the liquid system also during very cold operating conditions.

In order for proper functioning of the expansion tank, the tank must therefore not be completely filled at temperature operating point below a maximal temperature operating point. Instead, a preferred fill level of the tank must be carefully selected taking into account the temperature of the liquid at time of filling, the expansion volume needed for the liquid in the liquid system when operating at a maximal operating temperature, the liquid volume needed for compensating for liquid contraction when operating at a minimum operating temperature, and possibly also a certain liquid reserve volume for compensating for a certain loss of liquid from the system over time.

Filling of prior art storage tanks is for example performed manually or automated by filling the storage tank with a predetermined amount of liquid, or filling the storage until the fill level equals a predetermined fill level. While these solutions work well in some situations, there is still room for improvements in terms of filling of storage tanks.

SUMMARY OF THE INVENTION

This section provides a general summary of the disclosure, and is not a comprehensive disclosure of its full scope or all of its features.

One manner in which storage tanks may be filled with a liquid to a predetermined fill level is using a filling nozzle which extends a predetermined distance into the storage tank. The filling nozzle is inserted into the storage tank, e.g. from above, and used to fill the entire storage tank with the liquid. The same filling nozzle is then used, in the same position, to suck out, or extract the liquid. The length of the filling nozzle will consequently determine the resulting fill level of the storage tank. Thereby, a desired predetermined fill level of the tank can be quickly and simply achieved without measuring the quantity of liquid and without registering the current fill level of the storage tank. However, a difficulty may arise when attempting to fill tanks of different dimensions, especially storage tanks which have a relatively flat overall shape. In these cases, the filling nozzle may extend too far into the storage tank, which may leave the storage tank with a level of liquid which is too low. One might replace the filling nozzle with a shorter filling nozzle, or insert a distance piece between the filling equipment and the storage tank for raising the position of the filling nozzle. However, these solutions may increase time needed for perform filling, and may also result in erroneous fill level of the storage tank due to human error. Thus, in order to, among other things, avoid potentially costly replacement of the filling nozzles another solution is sought after which overcomes these difficulties.

An object of this disclosure is to provide a storage tank, a method of filling a storage tank, and a method for manufacturing a storage tank which enables simple filling of the storage tank while allowing a relatively flat overall shape of the storage tank.

An object of this disclosure is achieved by a storage tank according to the claims, wherein said storage tank comprises a main storage chamber, an internal sub chamber located within the storage tank, and a reclosable filling opening for enabling filling of liquid into the main storage chamber and internal sub chamber, wherein an overflow level of the internal sub chamber is located substantially at or above a predetermined fill level of the main storage chamber, and wherein the reclosable filling opening and the internal sub chamber are arranged in a substantially superposed relationship in a vertical direction, such that a substantially or entirely vertical stream of liquid filling the storage tank via the reclosable filling opening is configured to enter the internal sub chamber.

An example advantage of the storage tank is that a predetermined fill level can be controlled by the location or dimensions of the internal sub chamber rather than being fully dependent on the dimensions of the main storage chamber and filling nozzle. As the filling nozzle opening extends into the internal sub chamber, and liquid is sucked out using said nozzle, once the fill level of the storage tank is reduced to the overflow level of the internal sub chamber, only liquid in the internal sub chamber will be sucked out. The liquid level of the main storage chamber will thus be at the overflow level of the internal sub chamber. Thus, the internal sub chamber can be used to allow e.g. relatively flat storage tanks to have a higher predetermined fill level without having to replace the filling nozzle, and without having to modify the insertion length of the filling nozzle. This is particularly advantageous when filling different kinds of storage tanks using the same filling equipment. This scenario may occur for example when manufacturing different automobile models on a single manufacturing line.

Often, the resulting fill level directly after filling of the storage tank may correspond more or less exactly to a predetermined fill level. In such cases the overflow level of the internal sub chamber may preferably be located substantially at a predetermined fill level of the main storage chamber. However, in certain cases a higher fill level is desired directly after filling for compensating for air being trapped in the liquid system associated with the storage tank.

Such trapped air is generally automatically evacuated or otherwise removed from the liquid system during the initial operating time after filling, wherein liquid from the storage tank replaces the trapped air. The amount of replacement liquid needed may be predicted and the resulting fill level directly after filling may be selected to correspond to a predetermined fill level plus the predicted amount of replacement liquid. In such cases the overflow level of the internal sub chamber may preferably be located above a predetermined fill level of the main storage chamber, for the purpose of arriving at a fill level about the predetermined fill level a short time period after the filling event.

Depending on the what level is deemed to represent the predetermined fill level of the main storage chamber, the location of the overflow level of the internal sub chamber may be located more or less above the predetermined fill level of the main storage chamber for compensating for trapped air in the liquid system as the result of the assembly of the liquid system. When the predetermined fill level corresponds to an upper fill level marking denoting a max fill level of the storage tank, the overflow level may for example be about 10-30% above upper fill level marking. However, if for example a trigger level of a fill level sensor used for detecting low liquid level of the storage tank is used as predetermined fill level of the main storage chamber, the overflow level may for example be about 20-60% above the predetermined fill level marking.

The predetermined fill level corresponds thus herein to a desired fill level of the storage tank after a relatively short time period of operation of the liquid system associated with the storage tank, such as for example about 1 hour, depending on the type of liquid system. A longer time may be needed for large and complex liquid systems where the time for heating up the liquid system to normal operating temperature is relatively long.

The overflow level of the internal sub chamber corresponds herein to the level of liquid within the internal sub chamber at time of overflow of liquid from the internal sub chamber to the main chamber, i.e. a maximal fill level of the internal sub chamber. All at an orientation of the storage tank corresponding to an intended orientation of the storage tank at a finally installed and mounted state thereof.

According to some of the example embodiments, the predetermined fill level of the main storage chamber is indicated on the storage tank by means of at least one fill level marking. This allows for visual inspection of the fill level of the storage tank to determine the status thereof. This is often relevant for e.g. storage tanks in automobiles, thus allowing easy visual inspection of the fill level or levels by a user or service personnel. The fill level marking may for example be visible from the exterior of the storage tank and/or interior of the tank.

According to some of the example embodiments, the at least one fill level marking indicating a predetermined fill level of the main storage chamber includes an upper fill level marking indicating a first fill level and a lower fill level marking indicating a second fill level, wherein the first fill level corresponds to a larger filling volume than the second fill level, and wherein an overflow level of the internal sub chamber is located at or above the lower fill level marking, specifically at or above the upper fill level marking. This allows for visual inspection to determine multiple fill levels, and allows the overflow level of the internal sub chamber to be located at or above one or both fill levels. This is particularly relevant when e.g. servicing or repairing an automobile to allow a serviceman or a user to visually inspect the fill levels and determine whether the storage tank needs refilling.

According to some of the example embodiments, the storage tank comprises a fill level sensor located within the main storage chamber. The predetermined fill level of the main storage chamber is indicated by means of the fill level sensor. This allows for detection of the fill level in manners other than visual inspection, using e.g. an electronic sensor or a float switch or sensor. In particular fill level sensors having one or more recognizable discrete fill level trigger points may be used for indicating the predetermined fill level, such as a float-type fill level sensor, wherein a trigger point of the fill level sensor indicates the predetermined fill level.

According to some of the example embodiments, the storage tank is configured such that liquid will flow from the internal sub chamber of the main storage chamber upon overflow of the internal sub chamber. This allows the internal sub chamber to be used to control the flow of liquid into the main storage chamber.

According to some of the example embodiments, the internal sub chamber has a storage capacity of 1 to 100 milliliters, specifically 1 to 50 milliliters, more specifically 1 to 10 milliliters. The volume of the internal sub chamber is preferably relatively small because this requires less liquid to be sucked out from the internal sub chamber during the initial filling event, and less liquid becomes trapped and non-useable in the internal sub chamber in case of refill by pouring from refill bottle by a user or service personnel.

The storage capacity of the storage tank may for example be in the range of 0.5-20 liters, depending on the size of the liquid system associated with the storage tank. When the storage tank is used for automobiles the volume may be in the range of 0.5-5 liters.

The filling nozzle may for example have cylindrical hollow spout with an outer diameter of about 5-30 millimeters, depending on size of storage tank, and the internal sub chamber may have a cylindrical shape with a larger internal diameter than the outer diameter of the spout. The height of the internal sub chamber may for example be in the range of 15-100 millimeters, specifically in the range of 15-50 millimeters.

The vertical distance between the overflow level and exterior wall of storage tank in region of reclosable filling opening may typically be less than 50 millimeters, specifically less than 40 millimeters.

According to some of the example embodiments, the storage tank comprises an exterior wall that defines the main storage chamber, and the internal sub chamber is displaced from the exterior wall on all sides thereof. Having the internal sub chamber entirely integrated within the main chamber enables a compact outer dimension of the storage tank.

According to some of the example embodiments, than internal partition wall within the storage tank divides the main storage chamber from the internal sub chamber.

According to some of the example embodiments, the internal sub chamber is defined by a hollow rigid body with an open upper end and a closed lower end, and the internal sub chamber is formed between the upper and lower ends. This design enables a cost-effect manufacturing of the internal sub chamber.

According to some of the example embodiments, the storage tank comprises an upper injection moulded tank element having a closed end and an open end and a lower injection moulded tank element having a closed end and an open end, wherein the upper and lower tank elements are permanently connected to each other with their open ends facing each other such as to form a single piece storage tank, wherein the hollow rigid body is integrally formed with the upper tank element. This design enables a cost-effect manufacturing of the internal sub chamber.

According to some of the example embodiments, the open end of the upper tank element is oriented in a direction opposite the orientation of the open upper end of the hollow rigid body. The direction of orientation of an open end corresponds to the direction in the open end is facing.

According to some of the example embodiments, the storage tank is an expansion tank for storing a cooling liquid of a liquid cooling system. In such example embodiments, the first fill level may be associated with a label indicating maximum desired fill level and the second fill level may be associated with a label indicating minimum desired fill level.

A further object of this disclosure is achieved by a system comprising a storage tank and a filling nozzle for filling the storage tank with a liquid. The storage tank comprises a main storage chamber, an internal sub chamber located within the storage tank, and a reclosable filling opening for enabling filling of liquid into the main storage chamber and internal sub chamber, wherein an overflow level of the internal sub chamber is located substantially at or above a predetermined fill level of the main storage chamber, and wherein the reclosable filling opening and the internal sub chamber are arranged in a substantially superposed relationship in a vertical direction, such that a substantially or entirely vertical stream of liquid filling the storage tank via the reclosable filling opening is configured to enter the internal sub chamber. The filling nozzle comprises an abutment surface for abutting the reclosable filling opening of the storage tank, and a spout with an opening for filling liquid into the storage tank and sucking out superfluous liquid from the storage tank. The opening of the filling nozzle is located within the internal sub chamber when the filling nozzle is sealingly inserted into the reclosable filling opening and the abutment surface abuts the reclosable filling opening.

Another object of this disclosure is achieved by a method for filling a storage tank according to the claims.

According to some of the example embodiments of the method for filling a storage tank with a liquid, wherein the storage tank comprises a main storage chamber, an internal sub chamber located within the storage tank, and a reclosable filling opening for enabling liquid to be filled into the main storage chamber and internal sub chamber. The method comprises the steps of: introducing a filling nozzle into the reclosable filling opening, such that an abutment surface of the filling nozzle closes or contacts the reclosable filling opening of the storage tank, and such that an opening of the filling nozzle is located within the internal sub chamber; completely filling the main storage chamber and internal sub chamber by supplying liquid from the opening of the filling nozzle into the internal sub chamber, wherein supplied liquid will overflow from the internal sub chamber into the main storage chamber when the internal sub chamber is full; sucking out liquid from the internal sub chamber by means of the opening of the filling nozzle such that the liquid level in the main storage chamber equals the overflow level of the internal sub chamber; and withdrawing the filling nozzle from the reclosable filling opening.

A further object of this disclosure is achieved by a method for manufacturing a storage tank according to the claims.

According to some of the example embodiments of the method for manufacturing a storage tank according to the claims, wherein the storage tank comprises a main storage chamber, an internal sub chamber located within the storage tank, and a reclosable filling opening for enabling liquid to be filled into the main storage chamber and internal sub chamber. The method comprises the steps of: injection moulding a single piece upper tank element having: a closed end with the reclosable filling opening, an open end, and a hollow rigid body, wherein the hollow rigid body comprises an open upper end and a closed lower end, and wherein the internal sub chamber is formed between the upper and lower ends of the hollow rigid body, and wherein the reclosable filling opening and the internal sub chamber are positioned to be arranged in a substantially superposed relationship in a vertical direction in the assembled and installed storage tank, such that a substantially or entirely vertical stream of liquid filling the storage tank via the reclosable filling opening is configured to enter the internal sub chamber; injection moulding a single piece lower tank element having a closed end and an open end; and permanently connecting the upper and lower tank elements to each other with their open ends facing each other such as to form a single piece storage tank having the main storage chamber, the internal sub chamber, and the reclosable filling opening, wherein an overflow level of the internal sub chamber is located substantially at or above a predetermined fill level of the main storage chamber.

BRIEF DESCRIPTION OF DRAWINGS

The foregoing will be apparent from the following more particular description of the example embodiments, as illustrated in the accompanying figures in which like references characters refer to the same parts throughout the different views. The figures are not necessarily to scale, emphasis instead being placed upon illustrating the example embodiments through schematic figures.

DETAILED DESCRIPTION OF EXAMPLE EMBODIMENTS

Various aspects of the disclosure will hereinafter be described in conjunction with the appended drawings to illustrate and not to limit the disclosure, wherein like designations denote like elements, and variations of the described aspects are not restricted to the specifically shown embodiment, but are applicable on other variations of the disclosure.

Figure 1:
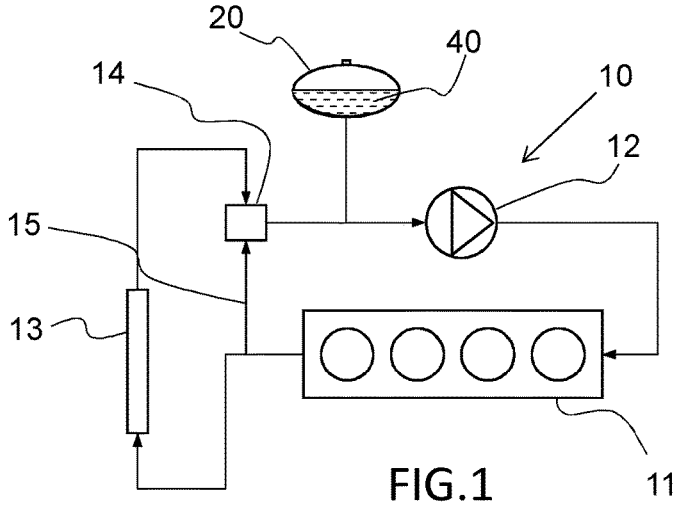
FIG. 1 shows a schematic of a storage tank connected to the cooling system of an engine.

With reference to FIG. 1 of the drawings, a schematic of a storage tank 20 being connected to the cooling system 10 of an engine 11, such as a combustion engine. The cooling system 10 and engine 11 may for example be installed in of a vehicle. The illustrated example cooling system 10 includes a pump 12, a thermostat valve 14 and a heat exchanger 13. Cooling liquid may be made to flow in the cooling system by means of the pump 12, such that cooling liquid being heated up by the engine 11 flows to the heat exchanger where it cools down, and back via the thermostat valve 14 and pump 12 to the engine 11. Excess cooling liquid 40 is stored in the storage tank 20. If the thermostat valve 14 determines that the temperature of the cooling liquid 40 is below a predetermined temperature, the thermostat valve allows cooling liquid 40 to by-pass the heat exchanger 13, such as to heat up faster. If the temperature of the cooling liquid 40 is at or above a predetermined temperature, the thermostat valve closes the by-pass line 15 is closed, and the liquid 40 flows through the heat exchanger 13 which cools the liquid 40 before proceeding through the thermostat valve towards the storage tank 20, pump 12 and engine 1.

The illustrated example embodiment of a cooling system merely describes an example embodiment of a cooling system and many variations are possible within the scope of the claims. Similarly, the storage tank is shown as a closed reservoir, but ventilation may be included to compensate for variable amount of air within the storage tank. A single or multiple inlet/outlet pipes may be used for conveying fluid to and from the storage tank.

Figure 2A:
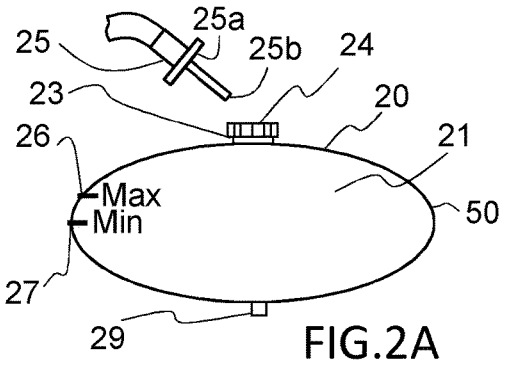
FIGS. 2A-2E show side cut views of a storage tank being filled at stages A through E.

FIGS. 2A through 2E show a storage tank 20 without an internal sub chamber which is being filled to achieve a predetermined fill level. The storage tank 20 may be installed in a cooling system as shown in FIG. 1. FIG. 2A shows a storage tank 20 which comprises a main storage chamber 21, a reclosable filling opening 23, a filling opening cap 24, and an inlet/outlet 29 connected to a cooling circuit. The storage tank 20 also comprises an upper fill level marking 26 indicating a maximum fill level of the main storage chamber 21 and a lower fill level marking 27 indicating a minimum fill level of the main storage chamber 21. Upon initial filling, i.e. after finalised assembly of the cooling system 10 but before first filling of the storage tank 20, the storage tank 20 is closed. The reclosable filling opening 23 is adapted to receive a filling nozzle 25.

The storage tank 20 is intended to act as an expansion tank. Apart from storing the cooling liquid 40 and serving as a filling point for refilling cooling liquid 40, the storage tank 20 allows for room for the cooling liquid 40 to expand, which is a common effect as the temperature of the cooling liquid 40 increases.

Figure 2D:
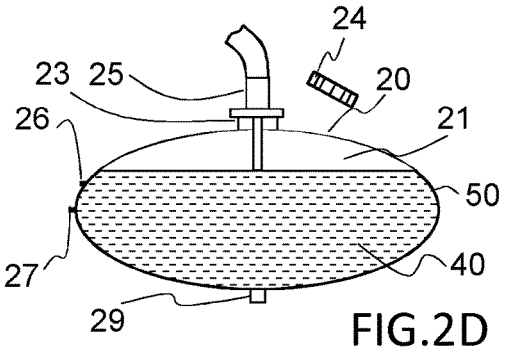
Figure 2B:
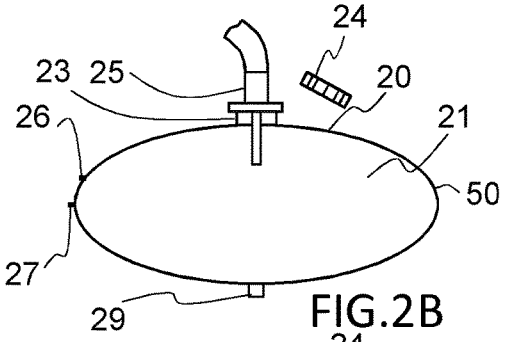

In FIG. 2B, the filling opening cap 24 has been removed from the reclosable filling opening 23, and a filling nozzle 25 has been inserted into the storage tank 20, extending a distance therein. An abutment surface 25*a* of the filling nozzle 25 abuts an upper rim of the reclosable filling opening 23, such that the reclosable filling opening 23 becomes closed. After this, the filling nozzle 25 is used to supply liquid 40 into the main storage chamber 21 of the storage tank 20 in order to fill the main storage chamber 21 completely.

Figure 2E:
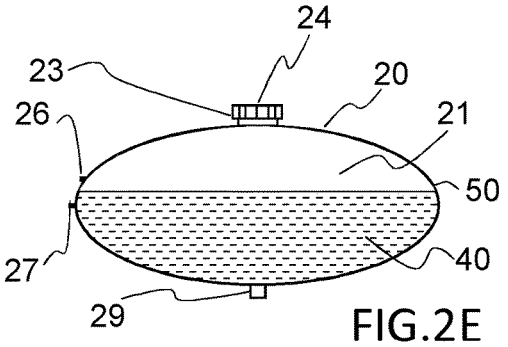
Figure 2C:
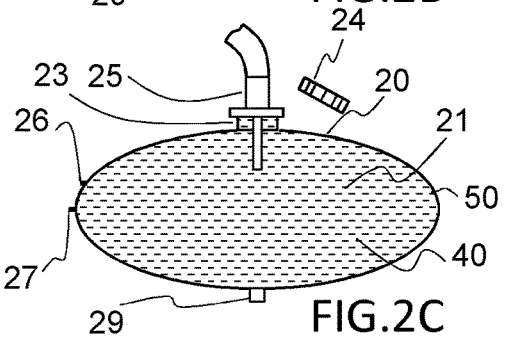

In FIG. 2C, the storage tank 20 has been supplied with liquid 40 through the filling nozzle 25 until the main storage chamber 21 is filled with liquid 40. In the next step, the filling nozzle 25 will be used for extracting, i.e. sucking out, the liquid 40 from the main storage chamber 21 for quickly and easy attaining a certain fill level.

In FIG. 2D, the filling nozzle 25 has been used to withdraw liquid 40 from the main storage chamber 21. By withdrawing as much liquid 40 as possible, the resulting fill level of the main storage chamber 21 will be at the same level as the extension of the filling nozzle 25 into the main storage chamber 21. In the storage tank 20 shown in FIGS. 2A-E, the filling nozzle 25 extends to a point above the upper fill level marking 26. Thereby, the resulting fill level of the storage tank 20 is above the predetermined fill level, which in FIG. 2D corresponds to the upper fill level marking 26.

In FIG. 2E, the filling nozzle 25 has been removed from the storage tank 20, and the reclosable filling opening 23 has been closed by the filling opening cap. After operation of the engine and cooling system for a short time period, air that was initially trapped in the cooling system upon assembly of the cooling system and engine has become evacuated and replaced with liquid from the storage tank 20. The fill level has therefore dropped a certain level, for example in the range between the upper fill level marking 26 and lower fill level marking 27. However, since the manufacturer wishes to have the fill level of the storage tank at the upper fill level marking 26 during a substantial amount of time after delivery of the engine cooling system to a customer, the final fill level depicted in FIG. 2E may be deemed unsatisfactory.

Figure 3A:
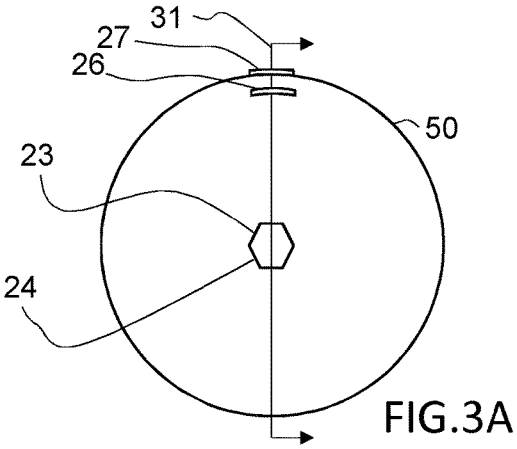
FIG. 3A shows a top view of a storage tank from above.
Figure 3B:
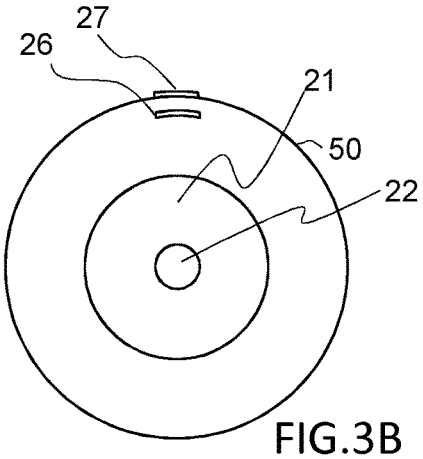
FIG. 3B shows a cross-section of a storage tank with an internal sub chamber from above.

FIGS. 3A and 3B show a top view of an example embodiment of a storage tank 20 according to the invention. FIGS. 4A through 4E show the same storage tank 20 as FIGS. 3A and 3B, but in a cut side view. The side cut of the view in FIGS. 4A-4E runs along the first plane 31 shown in FIG. 3A, essentially running along a centre line 33 of the storage tank 20. FIG. 3B shows a top cut view of the storage tank 20 along the second plane 32 indicated in FIG. 4A.

FIG. 3A shows the storage tank 20 and the filling cap 24. The storage tank 20 comprises two markings 26, 27. The first marking 26 shows the maximum fill level of the storage tank 20, and the second marking 27 shows the minimum fill level of the storage tank 20. While the filling cap 24 is shown in FIG. 3A to be hexagonal or the like for enabling good grip to a user. The cap 24 can have any shape suitable to allow it to be fastened by either tools or human hands. Shown in FIG. 3A is also a line showing the first plane 31 in which the side cut view of FIGS. 4A-4E is cut.

Figure 4A:
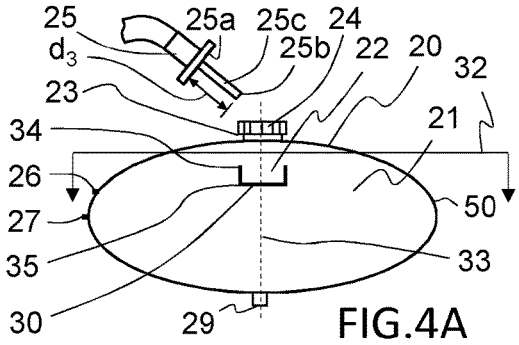
FIGS. 4A-4E show side cut views of a storage tank with an internal sub chamber being filled at stages A through E.

FIG. 3B shows a top cut view of the storage tank 20 along a second plane 32. The extension of said second plane 32 is shown in FIG. 4A. FIG. 3B shows an internal sub chamber 22 which is located directly beneath the reclosable filling opening 23. In other words, the internal sub chamber 22 is vertically superposed relatively the reclosable filling opening 23, such that a substantially or entirely vertical stream of liquid filling the storage tank via the reclosable filling opening is configured to enter the internal sub chamber when the storage tank is positioned in an angular orientation corresponding to an installation position of the storage tank within a vehicle. Thereby, when the filling nozzle 25 is inserted into the reclosable filling opening 23, and liquid 40 enters the storage tank 20 via said filling nozzle 25, the liquid 40 will mainly enter the internal sub chamber 22.

FIGS. 4A through 4E show the process of filling a storage tank 20 with liquid 40. FIGS. 4A through 4E are shown in a side cut view along the first plane 31. The storage tank 20 comprises the same components as the storage tank 20 shown in FIGS. 2A through 2E, with the addition of the internal sub chamber 22. The internal sub chamber 22 is formed by a hollow rigid body 30, which comprises an open upper end 34 and a closed end 35. The hollow rigid body 30 shown in FIG. 4A-4E is displaced from the exterior wall 50 of the main storage chamber 21 on all sides thereof. Not shown are connections, essentially plastic moulded details which connect the internal sub chamber 22 to the main storage chamber 21 at points near the reclosable filling opening 23. FIG. 4A also shows the second plane 32 in which the top view cut of FIG. 3B is cut. The reclosable filling opening 23, the internal sub chamber 22 and the inlet/outlet 29 are all arranged along a vertical centre axis of the storage tank 20.

The filling nozzle 25 may for example comprise a flange having an abutment surface 25*a* adapted to pushed against a top surface or upper rim of the reclosable a filling opening 23 of the storage tank 20. The abutment surface 25*a* of the filling nozzle may alternatively be adapted to contact and abut another surface associated with the reclosable a filling opening 23, such as an internal or external flange or shoulder. The filling nozzle may further comprise a spout 25*c* having an opening 25*b*, for example at the end thereof, for filling and sucking out superfluous coolant from the storage tank 20. The length $d_3$ between abutment surface 25*a* and the opening 25*b* may be in the range of 20-150 millimeters, specifically in the range of 30-100 millimeters. The spout may be cylindrical with a diameter in the range of 5-40 millimeters, specifically in the range of 7-20 millimeters.

Figure 4D:
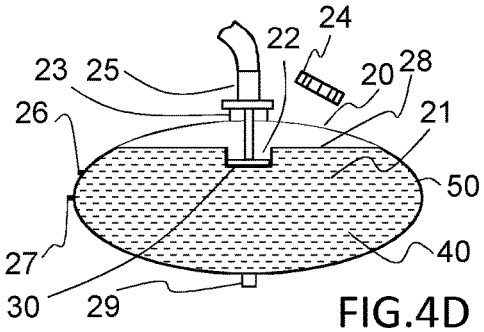
Figure 4B:
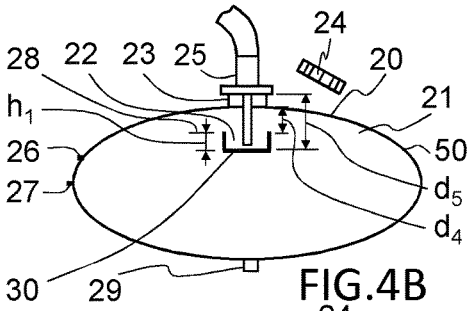

In FIG. 4B, the filling cap 24 is removed from the reclosable filling opening 23. The filling nozzle 25 is inserted into the storage tank 20, whereby the abutment surface 25*a* of the filling nozzle 25 engages an upper rim of the reclosable filling opening 23, such that the reclosable filling opening 23 becomes temporarily closed. Due to the location of the internal sub chamber 22 and the length of the spout 25*c*, the opening 25*b* of the spout 25*c* becomes located within the internal sub chamber 22.

The height $h_1$ of the internal sub chamber 22 may be in the range of 5-100 millimeters, specifically in the range of 10-50 millimeters. The internal sub chamber 22 is further arranged to allow coolant liquid to flow out from and in to the internal sub chamber 22 from the surrounding main storage chamber 21 at least via a portion of an upper rim of the open upper end 34 of the hollow rigid body 30. Said portion of the upper rim defines the overflow level 28 of the internal sub chamber 22, and thereby also the remaining fill level when liquid is sucked out from the internal sub chamber 22 via the opening 25*b* of the spout 25*c*. The opening 25*b* of the filling nozzle 25 is preferably located completely within the internal sub chamber 22 for ensuring that the upper rim of the open upper end 34 of the hollow rigid body 30 finally defines the remaining fill level when liquid is sucked out from the internal sub chamber 22 via the opening 25*b*.

The vertical distance $d_4$ between the overflow level 28 and the exterior wall 50 of storage tank 20 in a region of the reclosable filling opening 23 may typically be less than 50 millimeters, specifically less than 30 millimeters, thereby allowing the use of a relatively long spout 25*c* while enabling a high fill level after filling. A distance $d_5$ between an internal bottom of the internal sub chamber 22 and the upper rim of the reclosable filling opening 23 may be selected slightly larger than the length of the spout 25*c*, such that the spout 25*c* does not engage the internal bottom of the internal sub chamber 22 when the filling nozzle 25 is abutting the upper rim of the reclosable filling opening 23, while still enable the opening 25*b* of the spout 25*c* to be located within the internal sub chamber 22.

Subsequently, the main storage chamber 21 and the internal sub chamber 22 may be filled. Because of the positioning of the internal sub chamber and the filling nozzle 25, the liquid 40 entering the storage tank 20 will first fill up the internal sub chamber 22, upon which liquid 40 will overflow from the internal sub chamber 22 into the main storage chamber 21, thus filling the main storage chamber 21.

A pipe filling hose and filling nozzle 25 having a single flow path may be used, wherein the single flow path will alternatively be used for filling liquid into the storage tank 20 and sucking liquid out of the storage tank 20. Alternatively, a pipe filling hose and filling nozzle 25 having two flow paths may be used, wherein a first flow path may be used for filling liquid into the storage tank 20 and a second flow path may be used for sucking liquid out of the storage tank 20. If a multiple flow path filling nozzle 25 is used the opening of the first flow path arranged for filling liquid into the storage tank 20 may be located outside of the internal sub chamber 22.

Figure 4E:
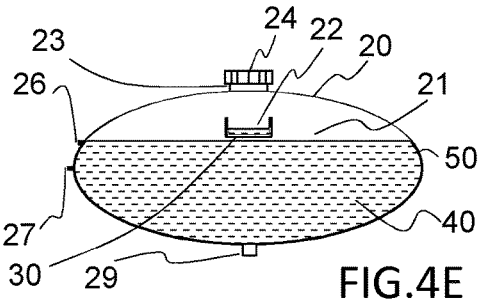
Figure 4C:
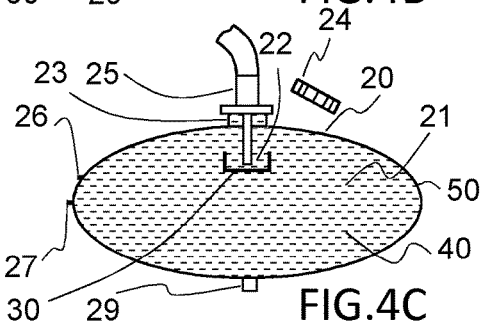

In FIG. 4C, the main storage chamber 21 and the internal sub chamber 22 have been filled. The abutment surface 25*a* closing the reclosable filling opening 23 may be used for ensuring that no liquid 40 will spill out of the storage tank 20. However, other sealing solutions may alternatively be used, such as for example radial sealing between the filling nozzle 25 and the reclosable filling opening 23. When the abutment surface 25*a* does not have a sealing functionality the abutment surface 25*a* may still have a positioning functionality for ensuring that the filling nozzle 25 is positioned in a correct axial position when filling the storage tank 20, i.e. ensuring that the filling nozzle 25 is inserted with a correct distance into the reclosable filling opening 23 or storage tank 20.

In FIG. 4D, the liquid 40 of the internal sub chamber 22 has been essentially sucked out by means of the opening 25*b* of the filling nozzle 25. Initially during the suction phase, liquid 40 from the internal sub chamber will be removed while liquid from the surrounding storage tank 20 will refill the internal sub chamber 22. However, once the fill level within the storage tank 20 reaches the overflow level 28 of the internal sub chamber 22, the filling nozzle 25 will only remove liquid 40 from the internal sub chamber 22, and not the remainder of the storage tank 20. This means that the resulting fill level of the storage tank 20 will be equal to the overflow level 28 of the internal sub chamber 22. Once it is detected that essentially no further liquid is sucked out from the internal sub chamber 22 the suction phase may be terminated. The fill level of the storage tank 20 can be assumed to be at the overflow level 28 of the internal sub chamber 22 once no more liquid 40 can be removed from the internal sub chamber 22.

The internal sub chamber 22 is preferable entirely closed and sealed at the closed end 35 of the hollow rigid body 30, but the existence of one or more small openings at the closed end 35 of the hollow rigid body 30 do not prevent the proper functionality of the disclosure as long as any openings at the closed end 35 are relatively small and the suction phase is relatively quick. The fill level after the suction phase will be essentially the same as when an entirely closed end 35 is used.

In FIG. 4E, the filling cap 24 has been returned to a position closing the reclosable filling opening 23. After operation of the engine and cooling system for a short time period, air that was initially trapped in the cooling system upon assembly of the cooling system and engine has become evacuated and replaced with liquid from the storage tank 20. The level of replacement liquid may be predicted and it may be desirable to overfill the storage tank with an amount corresponding to the predicted required replacement liquid volume, such that the final fill level of the storage tank 20 after a certain operating time corresponds to the upper fill level marking 26, which indicates a maximum fill level.

Figure 5:
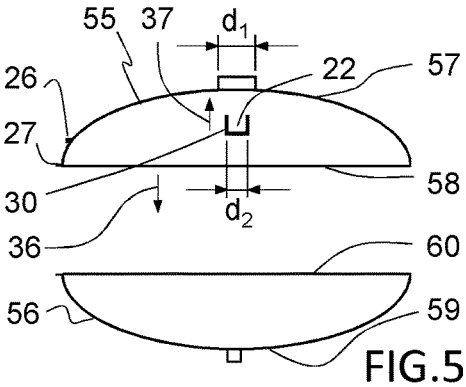
FIG. 5 shows a side cut views of an exploded view of a storage tank.

FIG. 5 shows an example embodiment how the storage tank 20 may be assembled. A single piece upper tank element 55 and a single piece lower tank element 56 may be manufactured by injection moulding. The single piece upper tank element 55 has a closed end 57 with the reclosable filling opening 23, an open end 58 and the hollow rigid body 30. The internal sub chamber 22 is formed between the upper and lower ends 34, 35 of the hollow rigid body 30. The single piece lower tank element 56 has a closed end 59 and an open end 60 as well as a suitable position for an inlet/outlet 29 in the closed end 59. The upper and lower tank elements 55, 56 are connected to each other with their open ends 58, 60 facing each other. Thus a single piece storage tank 20 having a main storage chamber 21, an internal sub chamber 22, reclosable filling opening 23 and an inlet/outlet 29 is formed. The predetermined fill level markings 26, 27 may be formed integrally with the exterior wall 50 of the storage tank 20. The overflow level 28 of the internal sub chamber 22 is located above the predetermined fill level markings 26, 27 in FIG. 5.

In the embodiment of the storage tank shown in FIGS. 3B, 4A-4E and 5, the open end 58 of the upper tank element 55 is oriented in a direction 36 opposite a direction 37 of orientation of the open upper end 34 of the hollow rigid body 30.

FIG. 5 further shows an advantageous relationship between an external width $d_2$ of the internal sub chamber 22, and an internal width $d_1$ of the interior of the reclosable filling opening 23. When the external width $d_2$ of the sub chamber 22 is smaller than the internal width $d_1$ of the interior of the reclosable filling opening 23, the hollow rigid body 30 forming the internal sub chamber may be made manufactured integrally with the upper tank element 55 in a single shot injection-moulding step, as described below.

Figure 6:
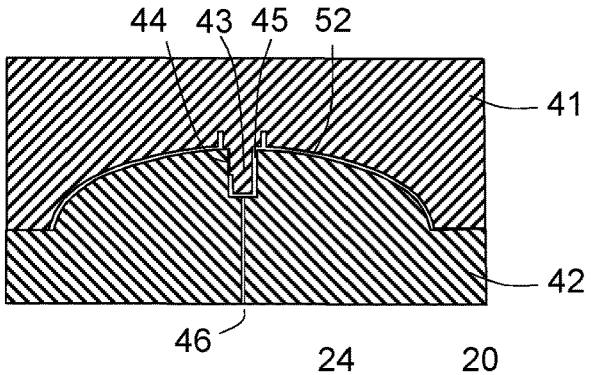
FIG. 6 shows a side cut view of example tool for manufacturing the storage tank.

An example tool used for manufacturing an upper tank element 55 by means of an injection-moulding process is depicted in FIG. 6. The tool may comprise an upper part 41 and a corresponding lower part 42, wherein the upper and lower parts 41, 42 are arranged to form a cavity 52 when forced together as shown on FIG. 6. The cavity is filled with plastic material during the injection-moulding step, thereby forming the upper tank element 55. The upper part 41 may be provided with an integrally formed projection 43 and the lower part 42 may be provided with a corresponding integrally formed recess for forming the internal sub chamber 22. The upper and lower parts 41, 42 may, in the region above the internal sub chamber, have metal-to-metal contact 44 in some circumferential areas and leaving a gap 45 in some other circumferential areas, for the purpose of forming the internal sub chamber integral with the upper tank element 55. The areas having metal-to-metal contact 44 will after manufacturing provide windows for allowing fluid entering the internal sub chamber to overflow into the main chamber, and the gap 45 in some other circumferential areas will after manufacturing provide the integrally formed connection elements permanently connecting the upper tank element 55 and hollow rigid body 30. A feed pipe 46 for feeding molten plastic material to the cavity of the injection moulding tool is schematically shown in FIG. 6.

Figure 7:
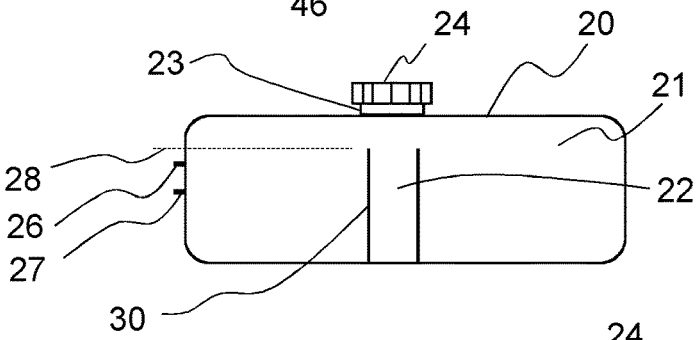
FIG. 7 shows a side cut view of an alternative embodiment of the storage tank.

FIGS. 7 through 10 show additional alternative embodiments of the invention. FIG. 7 shows a storage tank 20 where the hollow rigid body 30 extends down to a bottom side of the exterior wall 50 of the storage tank 20, such that the exterior wall 50 of the storage tank 20 partly defines the internal sub chamber 22. The upper rim of the hollow rigid body 30 defines the overflow level 28 as before.

Figure 8:
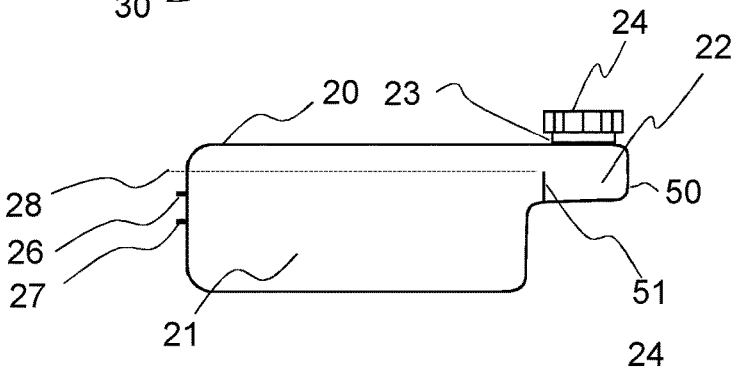
FIG. 8 shows a side cut view of a further alternative embodiment of the storage tank.

FIG. 8 shows a storage tank 20 which comprises an internal shelf arranged below the reclosable filling opening 23. The shelf is equipped with an internal partition wall 51 which, together with the exterior wall 50 of the storage tank 20 defines the internal sub chamber 22. The shelf may be designed to have a smaller depth in the vertical direction than the remaining part of the storage tank 20.

Figure 9:
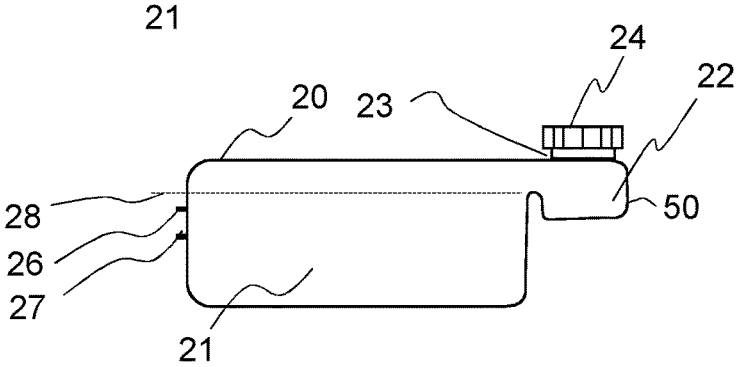
FIG. 9 shows a side cut view of yet an alternative embodiment of the storage tank.

FIG. 9 shows a storage tank 20 similar to the one shown in FIG. 8, but the exterior wall 50 of the storage tank 20 projects upwardly at the edge of the shelf to define the internal sub chamber 22.

Figure 10:
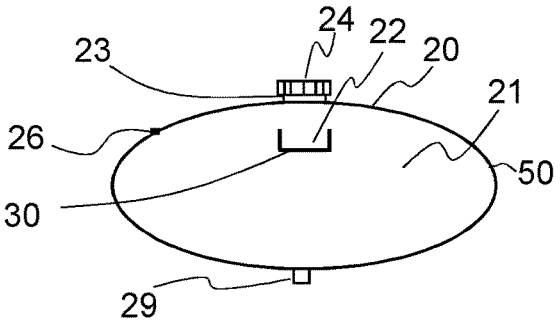
FIG. 10 shows a side cut view of a storage tank having a single fill level marking at a height corresponding to the overflow level of the internal sub chamber.

FIG. 10 shows a storage tank 20 in which the overflow level 28 of the internal sub chamber 22 is equal to a predetermined fill level, which in this example embodiment is defined by means of a marking 26 on the side of the storage tank 20.

Reference signs mentioned in the claims should not be seen as limiting the extent of the matter protected by the claims, and their sole function is to make claims easier to understand.

REFERENCE NUMBERS

10 Cooling system
11 Engine
12 Pump
13 Heat exchanger
14 Thermostat valve
15 By-pass line
20 Storage tank
21 Main storage chamber
22 Internal sub chamber
23 Reclosable filling opening
24 Filling cap
25 Filling nozzle
25*a* Abutment surface of filling nozzle
25*b* Opening of filling nozzle
25*c* Spout
26 Upper fill level marking
27 Lower fill level marking
28 Overflow level
29 Inlet/Outlet
30 Hollow rigid body
31 First plane
32 Second plane
33 Centre line
34 Open upper end
35 Closed lower end
36 Direction of orientation of open end of upper tank element
37 Direction of orientation of open upper end of hollow rigid body
40 Liquid
50 Exterior wall
51 Internal partition wall
52 Cavity
55 Upper tank element
56 Lower tank element
57 Closed end of upper injection moulded tank element
58 Open end of upper injection moulded tank element
59 Closed end of lower injection moulded tank element
60 Open end of lower injection moulded tank element

What is claimed is:

1. A storage tank for storing a liquid, wherein the storage tank comprises:

a main storage chamber;

an internal sub chamber located within the storage tank;

a reclosable filling opening for enabling filling of liquid into the main storage chamber and internal sub chamber; and an inlet/outlet located in an exterior wall of the main storage chamber and being configured to be connected to a cooling circuit of a liquid cooling system;

wherein an overflow level of the internal sub chamber is located substantially at or above a predetermined fill level of the main storage chamber, and wherein the reclosable filling opening and the internal sub chamber are arranged in a substantially superposed relationship in a vertical direction, such that a substantially or entirely vertical stream of liquid filling the storage tank via the reclosable filling opening is configured to enter the internal sub chamber before overflowing into the main storage chamber.

2. The storage tank according to claim 1, wherein the predetermined fill level of the main storage chamber is indicated on the storage tank by means of at least one fill level marking.

3. The storage tank according to claim 2, wherein the at least one fill level marking includes an upper fill level marking indicating a first fill level and a lower fill level marking indicating a second fill level, wherein the first fill level corresponds to a larger filling volume than the second fill level, and wherein an overflow level of the internal sub chamber is located at or above the lower fill level marking.

4. The storage tank according to claim 1, wherein the storage tank comprises a fill level sensor located within the main storage chamber, and wherein the predetermined fill level of the main storage chamber is indicated by means of the fill level sensor.

5. The storage tank according to claim 1, wherein the storage tank is configured such that liquid will flow from the internal sub chamber to the main storage chamber upon overflow of the internal sub chamber.

6. The storage tank according to claim 1, wherein the internal sub chamber has a storage capacity in the range of 1 to 100 milliliters.

7. The storage tank according to claim 1, wherein the storage tank comprises an exterior wall that defines the main storage chamber, and wherein the internal sub chamber is displaced from the exterior wall on all sides thereof.

8. The storage tank according to claim 1, wherein the storage tank comprises an exterior wall that partly defines the main storage chamber and partly defines the internal sub chamber.

9. The storage tank according to claim 1, wherein an internal partition wall within the storage tank divides the main storage chamber from the internal sub chamber.

10. The storage tank according to claim 1, wherein the internal sub chamber is defined by a hollow rigid body with an open upper end and a closed lower end, and the internal sub chamber is formed between the upper and lower ends.

11. The storage tank according to claim 10, wherein the storage tank comprises an upper injection moulded tank element having a closed end and an open end and a lower injection moulded tank element having a closed end and an open end, wherein the upper and lower tank elements are permanently connected to each other with their open ends facing each other such as to form a single piece storage tank, wherein the hollow rigid body is integrally formed with the upper tank element.

12. The storage tank according to claim 10, wherein the open end of the upper tank element is oriented in a direction opposite a direction of orientation of the open upper end of the hollow rigid body.

13. The storage tank according to claim 1, wherein the storage tank is an expansion tank for storing a cooling liquid of a liquid cooling system.

14. A system comprising-a storage tank according to claim 1 and a filling nozzle for filling the storage tank with a liquid, wherein the filling nozzle comprises:

an abutment surface for abutting the reclosable filling opening of the storage tank, and a spout with an opening for filling liquid into the storage tank and sucking out superfluous liquid from the storage tank, wherein the opening of the filling nozzle is located within the internal sub chamber when the filling nozzle is sealingly inserted into the reclosable filling opening and the abutment surface abuts the reclosable filling opening.

15. A system comprising:

a storage tank comprising:

a main storage chamber;

an internal sub chamber located within the storage tank; and a reclosable filling opening for enabling filling of liquid into the main storage chamber and internal sub chamber;

wherein an overflow level of the internal sub chamber is located substantially at or above a predetermined fill level of the main storage chamber;

wherein the reclosable filling opening and the internal sub chamber are arranged in a substantially superposed relationship in a vertical direction, such that a substantially or entirely vertical stream of liquid filling the storage tank via the reclosable filling opening is configured to enter the internal sub chamber; and a filling nozzle comprising:

an abutment surface for abutting the reclosable filling opening of the storage tank, and a spout with an opening for filling liquid into the storage tank and extracting superfluous liquid from the storage tank, wherein the opening of the filling nozzle is located within the internal sub chamber when the filling nozzle is inserted into the reclosable filling opening and the abutment surface abuts the reclosable filling opening.

16. The system according to claim 15, wherein the storage tank comprises an exterior wall that defines the main storage chamber, and wherein the internal sub chamber is displaced from the exterior wall on all sides thereof.

17. The system according to claim 15, wherein the storage tank comprises an exterior wall that partly defines the main storage chamber and partly defines the internal sub chamber.

18. The system according to claim 15, wherein the storage tank is configured such that, after the main storage chamber and internal sub chamber have been completely filled with the liquid, excess liquid may be extracted via a filling nozzle extended into the internal sub chamber of the storage tank such that once the fill level of the excess liquid within the main storage chamber is reduced to the overflow level of the internal sub chamber, the excess liquid within the internal sub chamber will be extracted.

19. The storage tank according to claim 1, wherein the storage tank is configured such that, after the main storage chamber and internal sub chamber have been completely filled with the liquid, excess liquid may be extracted via a filling nozzle extended into the internal sub chamber of the storage tank such that once the fill level of the excess liquid within the main storage chamber is reduced to the overflow level of the internal sub chamber, the excess liquid within the internal sub chamber will be extracted.

20. The storage tank according to claim 3, wherein the storage tank is configured such that, after the main storage chamber and internal sub chamber have been completely filled with the liquid, excess liquid may be extracted via a filling nozzle extended into the internal sub chamber of the storage tank such that once the fill level of the excess liquid within the main storage chamber is reduced to the overflow level of the internal sub chamber, the excess liquid within the internal sub chamber will be extracted.

21. The storage tank according to claim 9, wherein the storage tank is configured such that, after the main storage chamber and internal sub chamber have been completely filled with the liquid, excess liquid may be extracted via a filling nozzle extended into the internal sub chamber of the storage tank such that once the fill level of the excess liquid within the main storage chamber is reduced to the overflow level of the internal sub chamber, the excess liquid within the internal sub chamber will be extracted.

* * * * *